US009146507B2

(12) United States Patent
Mochizuki

(10) Patent No.: US 9,146,507 B2
(45) Date of Patent: Sep. 29, 2015

(54) IMAGE FORMING APPARATUS WITH VOLTAGE ADJUSTMENT

(71) Applicant: CANON KABUSHIKI KAISHA, Tokyo (JP)

(72) Inventor: Jun Mochizuki, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 78 days.

(21) Appl. No.: 13/908,399

(22) Filed: Jun. 3, 2013

(65) Prior Publication Data

US 2013/0330096 A1 Dec. 12, 2013

(30) Foreign Application Priority Data

Jun. 6, 2012 (JP) ..... 2012-128993

(51) Int. Cl.
*G03G 15/16* (2006.01)

(52) U.S. Cl.
CPC ..... *G03G 15/1675* (2013.01); *G03G 15/1645* (2013.01); *G03G 2215/0129* (2013.01)

(58) Field of Classification Search
CPC ..... G03G 15/1675; G03G 15/1645; G03G 2215/0129
USPC ..... 399/66, 313
See application file for complete search history.

(56) References Cited

U.S. PATENT DOCUMENTS 6,477,340 B2 11/2002 Tomizawa et al.
2011/0044710 A1* 2/2011 Shida ..... 399/66

FOREIGN PATENT DOCUMENTS

JP 10-207262 A 8/1998

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes: an image bearing member; a toner image forming portion; a transfer member; a power source configured to apply a voltage to the transfer member so that a level of the voltage in a non-sheet-passing period in which a recording material is not in a transfer position is the same as that in a preceding sheet-passing period in which the recording material is in the transfer position; a current detecting member configured to detect a current flowing through the transfer member; and a controller configured to correct the voltage applied by the power source for the subsequent sheet-passing period on the basis of the detected current by the current detecting member in the non-sheet-passing period so that a predetermined current flows through the transfer member in the sheet-passing period.

8 Claims, 8 Drawing Sheets

IMAGE FORMING APPARATUS WITH VOLTAGE ADJUSTMENT

FIELD OF THE INVENTION AND RELATED ART

The present invention relates to an image forming apparatus such as a copying machine, a printer, a facsimile machine or a multi-function machine of these machines. Particularly, the present invention relates to control of a voltage to be applied when a toner image is transferred from an intermediary transfer member onto a recording material.

In a conventional image forming apparatus, a structure of an intermediary transfer type in which the toner image formed on a photosensitive drum is once transferred onto an intermediary transfer belt (member) and then is transferred onto the recording material has been known. In such a structure, a transfer to which a transfer voltage is applied is provided at each of a primary transfer portion where the toner image is transferred from the photosensitive drum onto the intermediary transfer belt, and a secondary transfer portion where the toner image is transferred from the intermediary transfer belt onto the recording material. As the transfer member, from viewpoints of ozone-less charging and a low cost, also a structure in which a contact charging type using an elastic roller is employed has been known.

With respect to such an elastic roller, it is difficult to suppress a variation in resistance during manufacturing, and in addition, the resistance is changed due to a temperature and humidity change in an ambient environment. Therefore, in the structure using the contact charging type, a structure in which an optimum transfer voltage is set, by detecting the resistance of the transfer member in a period other than a period in which the image is transferred, in control which is called ATVC (Active Transfer Voltage Control) has been proposed. Further, also a structure in which constant voltage control by which a set transfer voltage is applied as a constant voltage has been known.

Such ATVC is carried out at the time when an image forming operation in many cases, but in these cases, the resistance of the transfer member is changed by the temperature and humidity change or electric energy (power) supply during the image formation. Accordingly, even when the constant voltage control is effected at a voltage determined by ATVC at the time of start of the image formation, by a change in resistance value of the transfer member during continuous image formation, an optimum transfer current cannot be obtained in some cases. Particularly, in the case where an ion conductive transfer member is used, a change in resistance characteristic depending on the temperature is large, and therefore this problem is conspicuous.

Therefore, Japanese Laid-Open Patent Application (JP-A) Hei i10-207262 has proposed the following structure. That is, separately from ATVC (PTVC) to be effected during non-sheet passing such as a period before start of image formation, at a sheet interval (a non-sheet-passing period between consecutively passed recording materials) during the continuous image formation, a voltage for the time of sheet passing different from a voltage for the time of non-sheet passing is applied, and then a current is detected. Then, on the basis of the detected current, a transfer voltage during the sheet passing of the recording material is corrected.

On the other hand, in recent years, it is required that image formation at high speed (high-speed printing) is effected, and in order to realize the high-speed printing, such a method that an image forming speed (sheet passing speed) is increased or the sheet interval is shortened is employed. The method of increasing the image forming speed (sheet passing speed) involves a problem in terms of upsizing of a driving means and a fixing property. On the other hand, the method of shortening the sheet interval is capable of achieving the high-speed printing while suppressing increases in size and cost of the image forming apparatus.

However, in the case where the sheet interval is shortened in order to realize the high-speed printing, the constitution described in JP-A Hei 10-207262 does not readily meet the method of shortening the sheet interval. That is, in the constitution in JP-A Hei 10-207262, different values are set for voltages applied during the sheet passing and during the non-sheet passing. Specifically, the voltage during the sheet passing is set at a value lower than the voltage during the non-sheet passing, and an operation for switching the voltage in the sheet interval is described. In JP-A Hei 10-207262, an object of setting the voltage at the lower value during the sheet passing is not described but it would be considered that a current flows in a large amount during the sheet passing when the same voltage is applied during the non-sheet passing and during the non-sheet passing and therefore the object is to avoid the current flowing in the large amount during the non-sheet passing.

However, in order to detect the current after the voltage is switched, a time required to stabilize the voltage and the current is needed but when the sheet interval is shortened gradually, a time required to detect the current stably cannot be ensured. Accordingly, as in the structure described in JP-A Hei 10-207262, when the voltages applied during the sheet passing and during the non-sheet passing are made different from each other, the sheet interval is not readily shortened and thus the structure does not readily meet the high-speed printing.

SUMMARY OF THE INVENTION

In view of the above-described circumstances, the present invention has been accomplished. A principal object of the present invention is to provide an image forming apparatus capable of effecting image formation at high speed while properly controlling a transfer voltage to be applied to a transfer member.

According to an aspect of the present invention, there is provided an image forming apparatus comprising: an image bearing member; a toner image forming portion configured to form a toner image on the image bearing member; a transfer member configured to transfer the toner image from the image bearing member onto a recording material at a transfer portion; a power source configured to apply a voltage to the transfer member so that a level of the voltage in a non-sheet-passing period in which the recording material is not in the transfer position is the same as that in a preceding sheet-passing period in which the recording material is in the transfer position; a current detecting member configured to detect a current flowing through the transfer member; and a controller configured to correct the voltage applied by the power source for the subsequent sheet-passing period on the basis of the detected current by the current detecting member in the non-sheet-passing period so that a predetermined current flows through the transfer member in the sheet-passing period.

According to the image forming apparatus of the present invention, on the basis of the current detected by a current detecting means under application of the voltage during non-sheet passing, the voltage to be applied to the transfer member is corrected so that a target current flows through the transfer member during the sheet passing, and therefore the transfer voltage to be applied to the transfer member can be properly controlled. Further, the voltage is applied to the transfer member without being changed between during the sheet passing and during the non-sheet passing, and therefore a current detection time during the non-sheet passing can be shortened. For this reason, the sheet interval which is a non-sheet-passing period can be shortened, so that the image can be formed at high speed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<First Embodiment>

Figure 1:
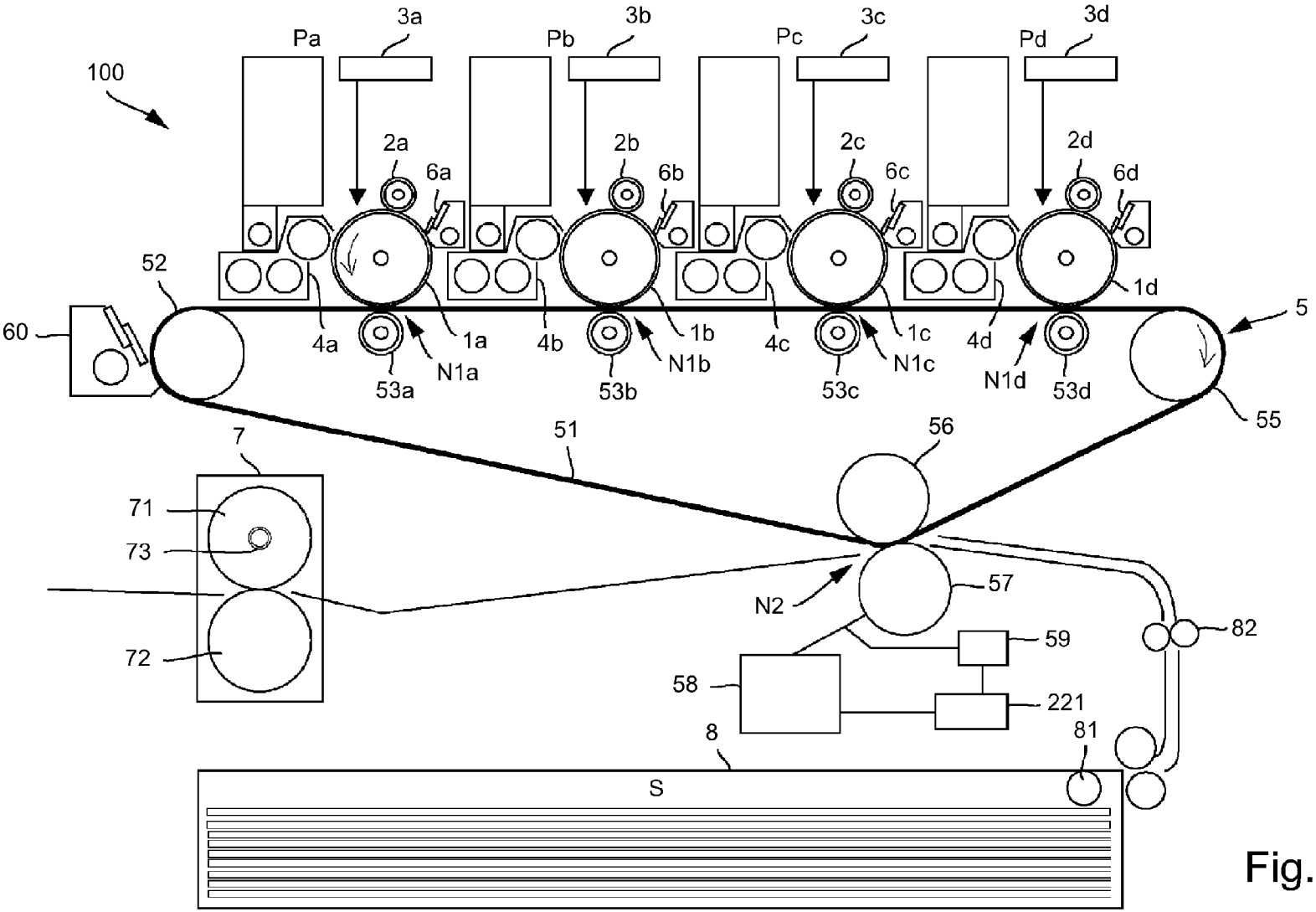
FIG. 1 is a schematic illustration of an image forming apparatus in First Embodiment of the present invention.

First Embodiment of the present invention will be described with reference to FIG. 1 to FIG. 6. First, a schematic structure of an image forming apparatus in this embodiment will be described with reference to FIG. 1.

[Image Forming Apparatus]

An image forming apparatus 100 includes a plurality of image forming portions and is a full-color electrophotographic image forming apparatus using an intermediary transfer type. First to fourth image forming portions (process units) Pa, Pb, Pc and Pd as the plurality of image forming portions are used for forming toner images of yellow, magenta, cyan and black, respectively. In this embodiment, constitutions of the respective image forming portions Pa to Pd are substantially the same except that colors of toner images used therein are different from each other. Accordingly, in the following, in the case where they are not particularly required to be differentiated from each other, suffixes a, b, c and d added to reference numerals in the figures for representing constituent elements provided for associated one of the colors are omitted and each of the constituent elements will be described collectively.

The image forming portion P includes a photosensitive drum 1 for bearing the toner image. At a periphery of the photosensitive drum 1, a charging roller 2 as a primary charging means, a laser scanner 3 as an exposure means, a developing device 4 as a developing means, a drum cleaner 6 as a drum cleaning means, and the like are successively provided along a rotation direction of the photosensitive drum 1. Further, adjacently to the respective photosensitive drums 1*a* to 1*d* of the image forming portions Pa to Pd, a circulatory-movable belt member as an intermediary transfer member, i.e., an intermediary transfer belt 51 as an image bearing member is provided.

The intermediary transfer belt 51 is stretched around, as a plurality of supporting members, a driving roller 52, a follower roller 55 and an inner secondary transfer roller 56. The intermediary transfer belt is moved and circulated in an indicated arrow direction by transmitting thereto a driving force by the driving roller 52 as a belt driving means. Further, in an inner peripheral surface side of the intermediary transfer belt 51, at a position opposing the photosensitive drums 1*a* to 1*d*, primary transfer rollers 53*a* to 53*d* as a primary transfer member are provided. By the primary transfer rollers 53*a* to 53*d*, the intermediary transfer belt 51 is urged toward the photosensitive drums 1*a* to 1*d*, respectively, the form primary transfer portions (primary transfer nips) N1*a* to N1*d* where the intermediary transfer belt 51 is contacted to the photosensitive drums 1*a* to 1*d*, respectively.

Further, in an outer peripheral surface side of the intermediary transfer belt 51, at a position opposing the inner secondary transfer roller 56, an outer secondary transfer roller 57 as a secondary transfer member is provided. Further, by contact of the outer secondary transfer roller 57 with the outer peripheral surface of the intermediary transfer belt 51, a secondary transfer portion (secondary transfer nip) N2 is formed.

The images formed on the photosensitive drums 1*a* to 1*d* at the image forming portions Pa to Pd are successively transferred superposedly onto the intermediary transfer belt 51 which adjacently moves and passes along the photosensitive drums 1*a* to 1*d*. Thereafter, the images transferred on the intermediary transfer belt 51 are further transferred onto a recording material S such as paper at the secondary transfer portion N2. That is, by applying a transfer voltage to the outer secondary transfer roller 57, the toner images are transferred from the intermediary transfer belt 51 onto the recording material S passing through the secondary transfer portion N2. To the outer secondary transfer roller 57, the voltage is applied from a secondary transfer bias power source 58.

[Image Forming Portion]

A detailed structure of the image forming portion P will be described also with reference to FIG. 2. The photosensitive drum 1 is rotatably supported by an image forming apparatus main assembly. The photosensitive drum 1 is a cylindrical electrophotographic photosensitive member having a basis structure including an electroconductive support 11 of aluminum or the like and a photo-conductive layer 12 formed on an outer peripheral surface of the support 11. The photosensitive drum 1 includes a supporting shaft 13 at its center. The photosensitive drum 1 is rotationally driven about the supporting shaft 13 in an indicated arrow R1 direction by a driving means (not shown). In this embodiment, a charge polarity of the photosensitive drum 1 is negative.

Figure 2:
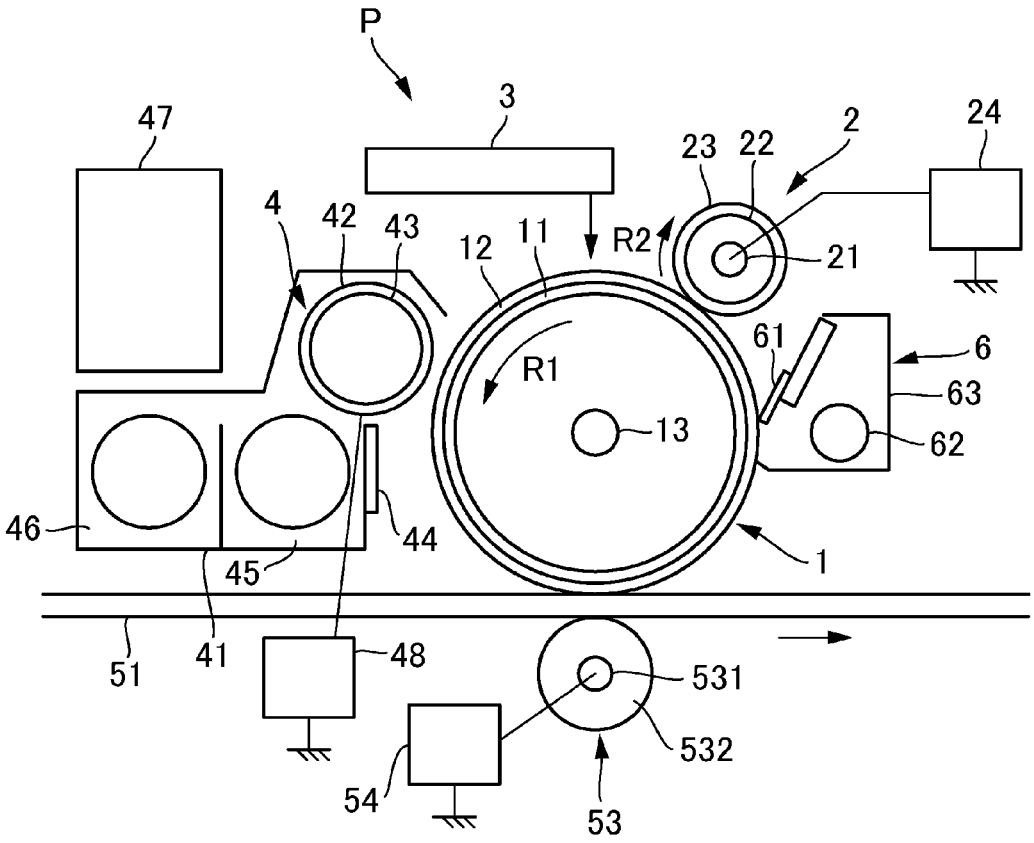
FIG. 2 is a schematic illustration of an image forming portion constituting the image forming apparatus.

On the photosensitive drum 1 at an upper portion of FIG. 2, the charging roller 2 as the primary charging means is disposed. The charging roller 2 contacts the surface of the photosensitive drum 1 to electrically charge the surface of the photosensitive drum 1 uniformly to a predetermined polarity and a predetermined potential. The charging roller 2 includes an electroconductive core metal 2 provided at the center thereof, a low-resistance electroconductive layer 22 formed on an outer peripheral surface of the core metal 21, and a medium-resistance layer 23, and is formed in a roller shape as a whole. The charging roller 2 is rotatably supported by a bearing member (not shown) at each of end portions of the core metal 21 and is disposed in parallel to the photosensitive drum 1. Each of the bearing members at the end portions is urged toward the photosensitive drum 1 by an urging means (not shown). As a result, the charging roller 2 is press-contacted to the surface of the photosensitive drum 1 at predetermined pressure (urging force). The charging roller 2 is rotated in an indicated arrow R2 direction by rotation of the photosensitive drum in the arrow R1 direction. To the charging roller 2, a charging bias voltage is applied from a charging bias power source 24 as a charging bias output means. As a result, the surface of the photosensitive drum 1 is contact-charged uniformly.

In a downstream side of the charging roller with respect to the rotational direction of the photosensitive drum 1, the laser scanner 3 is disposed. The laser scanner 3 scans the surface of the photosensitive drum 1 to expose the photosensitive drum 1 to laser light while turning off and on the laser light on the basis of image information. As a result, an electrostatic image (latent image) depending on the image information is formed on the photosensitive drum 1.

In the downstream side of the laser scanner 3 with respect to the rotational direction of the photosensitive drum 1, the developing device 4 is disposed. The developing device 4 includes a developing container 41 in which as a developer, a two-component developer containing non-magnetic toner particles (toner) and magnetic carrier particles (carrier) is accommodated. At an opening of the developing container 41 facing the photosensitive drum 1, a developing sleeve 42 as a developer carrying member is rotatably provided. Inside the developing sleeve 42, a magnet roller 43 as a magnetic field generating means is fixedly provided in a non-rotatable state against the rotation of the developing sleeve 42. By the magnetic field formed by the magnet roller 43, the two-component developer is carried on the developing sleeve 42. Further, at a lower position of the developing sleeve 42 in FIG. 2, a regulating blade 44 as a developer regulating member for regulating the two-component developer, carried on the developing sleeve 42, so as to form a thin layer is provided. The inside of the developing container 41 is partitioned into a developing chamber 45 and a stirring chamber 46, and above the developing container 41, a supplying chamber 47 in which a toner for supply is accommodated is provided.

The thin layer of the two-component developer on the developing sleeve 42 is conveyed to a developing region opposing the photosensitive drum 1. Then, the two-component developer on the developing sleeve 42 is erected to form a chain in the developing region by a magnetic force of a principal developing pole of the magnet roller 43 located in the developing region, so that a magnetic brush of the two-component developer is formed. By this magnetic brush, the surface of the photosensitive drum 1 is rubbed, and at the same time, a developing bias voltage is applied to the developing sleeve 42 from a developing bias power source 48 as a developing bias output means. As a result, the toner deposited on the carrier constituting the chain of the magnetic brush is deposited on the electrostatic image on the photosensitive drum 1 at an exposed portion, so that the toner image is formed. In this embodiment, the toner image is formed on the toner image by reversal development in which the toner charged to an identical polarity to the charge polarity of the photosensitive drum 1.

Below the photosensitive drum 1 in FIG. 2 in the downstream side of the developing device 4 with respect to the rotational direction of the photosensitive drum 1, a primary transfer roller 53 is provided. The primary transfer roller 53 is constituted by a core metal 531 and an electroconductive layer 532 formed in a cylindrical shape no an outer peripheral surface of the core metal 531. The primary transfer roller 53 is urged toward the photosensitive drum 1 by an urging member (not shown) at each of end portions thereof. As a result, the electroconductive layer 532 of the primary transfer roller 53 is press-contacted to the intermediary transfer belt 51 toward the surface of the photosensitive drum 1 at predetermined pressure. Further, to the core metal 531, a primary transfer bias power source 54 as a primary transfer bias output means is connected.

The primary transfer portion N1 is formed between the photosensitive drum 1 and the intermediary transfer belt 51. The intermediary transfer belt 51 is sandwiched between the photosensitive drum 1 and the primary transfer roller 53 at the primary transfer portion N1. The primary transfer roller 53 is rotated with movement of the intermediary transfer belt 51 in contact with the inner peripheral surface of the intermediary transfer belt 51. Then, during image formation, to the primary transfer roller 53, a primary transfer bias voltage of an opposite polarity (second polarity: positive in this embodiment) to a normal charge polarity (first polarity: negative in this embodiment) of the toner is applied by a primary transfer bias power source 54. Thus, between the photosensitive drum 1 and the primary transfer roller 53, an electric field by which the toner of the first polarity is moved from the photosensitive drum 1 toward the intermediary transfer belt 51. As a result, the toner image on the photosensitive drum 1 is transferred (primary-transferred) onto the surface of the intermediary transfer belt 51.

A deposited matter such as a toner (primary transfer residual toner) remaining on the surface of the photosensitive drum 1 after the primary transfer step is removed by the drum cleaner 6. The drum cleaner 6 includes a cleaning blade 61 as a drum cleaning member, a feeding screw 62 and a drum cleaner housing 63. The cleaning blade 61 is press-contacted to the photosensitive drum 1 by a pressing means (not shown) at a predetermined angle and predetermined pressure. As a result, the toner or the like remaining on the surface of the photosensitive drum 1 is scraped off from the photosensitive drum 1 by the cleaning blade 61, and then is collected in the drum cleaner housing 63. The collected toner or the like is fed by the feeding screw 62 and then is discharged into a residual toner accommodating portion (not shown).

In FIG. 1, under the photosensitive drums 1*a* to 1*d*, an intermediary transfer unit 5 including the intermediary transfer belt 51, the primary transfer rollers 53*a* to 53*d*, the inner secondary transfer roller 56, the outer secondary transfer roller 57, an intermediary transfer belt cleaner 60, and the like is constituted. The inner secondary transfer roller 56 is electrically grounded. Further, to the outer secondary transfer roller 57, the secondary transfer bias power source 58 as the secondary transfer bias output means is connected. The inner secondary transfer roller 56 is rotated with the movement of the intermediary transfer belt 51 in contact with the inner peripheral surface of the intermediary transfer belt 51.

For example, during full-color image formation, the respective color toner images are formed on the photosensitive drums 1*a* to 1*d* of the first to fourth image forming portions Pa to Pd. These color toner images are supplied with the primary transfer bias from the respective primary transfer rollers 53 opposing the photosensitive drums 1*a* to 1*d* via the intermediary transfer belt 51, thus being transferred (primary-transferred) successively onto the intermediary transfer belt 51. These toner images are conveyed to the secondary transfer portion N2 with the rotation of the intermediary transfer belt 51.

On the other hand, until this time, the recording material S is conveyed to the secondary transfer portion N2 by a recording material feeding means. That is, in the recording material feeding means, the recording material S taken out one by one from a cassette 8 as a recording material accommodating portion by a pick-up roller 81 is conveyed to the secondary transfer portion N2 by a conveying roller 82 and the like.

To the outer secondary transfer roller 57, by the secondary transfer bias power source 58, the secondary transfer bias voltage (transfer voltage) of the opposite polarity (second polarity: positive in this embodiment) to the normal charge polarity (first polarity: negative in this embodiment) of the toner is applied. Thus, between the inner secondary transfer roller 56 and the outer secondary transfer roller 57, an electric field in a direction in which the toner of the first polarity is moved from the intermediary transfer belt 51 toward the recording material S is formed. As a result, the toner image on the intermediary transfer belt 51 is transferred (secondary-transferred) onto the recording material S passing through the secondary transfer portion N2. The recording material P onto which the toner image is transferred at the secondary transfer portion N2 is conveyed to a fixing device 7 as a fixing means.

Incidentally, a deposited matter such as a toner (secondary transfer residual toner) remaining on the outer peripheral surface of the intermediary transfer belt 51 after the secondary transfer step is removed and collected by the intermediary transfer belt cleaner 60. The intermediary transfer belt cleaner 60 has the same constitution as the drum cleaner 6.

The fixing device 7 includes a rotatably provided fixing roller 71 and a pressing roller 72 rotating in press-contact with the fixing roller 71. Inside the fixing roller 71, a heater 73 such as a halogen lamp is provided. Further, by controlling a voltage or the like supplied to the heater 73, temperature control of the surface of the fixing roller 71 is effected. When the recording material S is conveyed into the fixing device 7, the recording material S is, when being passed between the fixing roller 71 and the pressing roller 72 which rotate at a constant speed, pressed and heated at substantially constant pressure and temperature from both surfaces thereof. As a result, an unfixed toner image on the surface of the recording material S is melted and then fixed on the recording material S. Thus, a full-color image is formed on the recording material S.

Incidentally, the intermediary transfer belt 51 can be constituted by a dielectric resin material such as PC (polycarbonate), PET (polyethylene terephthalate) or PVDF (polyvinylidene fluoride). In this embodiment, as the intermediary transfer belt 51, a 100 μm-thick PI belt having a surface resistance of $10^{12}$ Ω/sq (measured by using a probe in accordance with JIS-K 61 under a condition including an applied voltage of 100 V, an application time of 60 seconds, and an environment of 23° C. and 50% RH was used. However, the intermediary transfer belt 51 is not limited thereto, but may also be those formed of other materials to have appropriate volume resistivity and thickness.

The primary transfer roller 53 is constituted by a core metal of 8 mm in outer diameter and a 4 mm-thick electroconductive urethane sponge layer. An electric resistance value of the primary transfer roller 53 was about $10^7$Ω (23° C./50% RH). The electric resistance value of the primary transfer roller 53 is obtained from a current value measured, under application of a voltage of 500 V to the core metal, by rotating the primary transfer roller 53 at a peripheral speed of 50 mm/sec in contact with a metal roller grounded at a load of 500 g-weight.

Further, the inner secondary transfer roller 56 is constituted by a core metal of 18 mm in outer diameter and an electroconductive solid silicone rubber layer of 4 mm in thickness. The electric resistance value of the inner secondary transfer roller 56 was about $10^4$Ω as measured under application of a voltage of 50 V in the same manner as in the primary transfer roller 53.

Further, the outer secondary transfer roller 57 is constituted by a core metal of 10 mm and a 4 mm-thick electroconductive EPDM rubber sponge layer as an ion-conductive elastic layer. The electric resistance value of the outer secondary transfer roller 57 was about $10^8$Ω as measured under application of a voltage of 200 V in the same manner as in the primary transfer roller 53.

[Control of Voltage to be Applied to Outer Secondary Transfer Roller]

Figure 3:
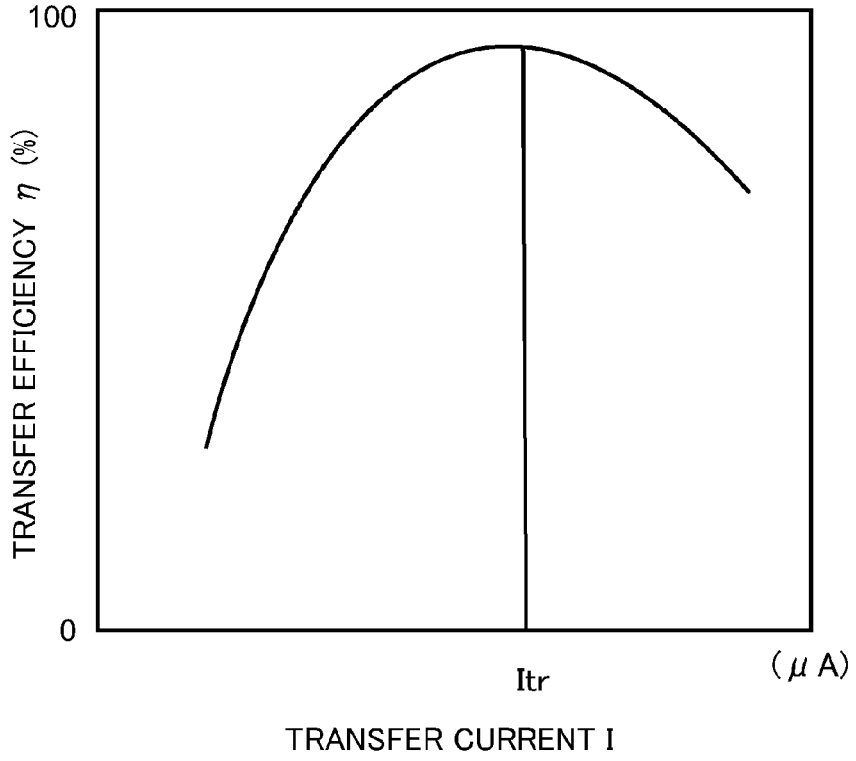
FIG. 3 is a graph showing a relationship between a transfer current and a transfer efficiency.

Control of the voltage to be applied to the outer secondary transfer roller 57 in this embodiment will be specifically described. FIG. 3 is a graph showing a relationship between a transfer current I and a transfer efficiency η of the toner image from the intermediary transfer belt 51 onto the recording material S when the toner image is transferred from the intermediary transfer belt 51 onto the recording material S (during sheet passing).

According to study of the present inventor, as shown in FIG. 3, with an increasing transfer current I, the transfer efficiency from the intermediary transfer belt 51 onto the recording material S is increased and becomes a maximum in the neighborhood of a predetermined transfer current Itr. Then, when the transfer current is further increased to a value higher than the predetermined transfer current Itr, such a phenomenon that the transfer efficiency starts to be lowered occurs. At this time, it would be considered that electric discharge occurs between the intermediary transfer belt 51 and the recording material S to cause polarity inversion of the toner and thus the toner is attracted again to the intermediary transfer belt side. Thus, the transfer efficiency of the toner image depends on the transfer current, and therefore the transfer voltage may preferably be applied so that an optimum outer Itr flows.

However, in the case where constant current control in which the transfer current is constant is employed as a transfer voltage applying method, depending on a widthwise size of the recording material S, a current flowing through a region of the recording material S is different. This will be described. In the case where the width of the recording material S is smaller than the width of the outer secondary transfer roller 57, there are two regions (1) and (2). That is, at the secondary transfer portion N2 shown in FIG. 1, the region (1) is formed by the outer secondary transfer roller 57, the recording material S, the intermediary transfer belt 51 and the inner secondary transfer roller 56, and the region (2) is formed by the outer secondary transfer roller 57, the intermediary transfer belt 51 and the inner secondary transfer roller 56. In the region (1), the resistance is high correspondingly to the presence of the recording material S.

The regions (1) and (2) can be represented by a parallel circuit, and therefore in the case where the constant current control is effected, the control is made so that a predetermined current value is ensured by using the regions (1) and (2) in combination. The change in width of the recording material S means that a ratio between the regions (1) and (2) is changed and therefore the current flowing through the region (1), i.e., the region where the recording material S is located varies depending on the width of the recording material S. For example, in the case where the width of the recording material S is narrow, the current flowing through the region (1) is decreased.

Therefore, as a method which is not adversely affected by the recording material width, constant voltage control in which the transfer voltage is constant is used. In the constant voltage control, the voltage is constant irrespective of the recording material width, and therefore the current flowing through the recording material region is also constant. However, only by effecting the constant voltage control, the transfer current cannot be ensured in the case where the resistance of the transfer member is fluctuated. In this embodiment, the outer secondary transfer roller 57 of the image forming apparatus 100 is the elastic roller using the sponge layer (elastic layer) of the EPDM rubber. However, it is difficult for the elastic roller including the ion-conductive elastic layer to suppress a variation in resistance during manufacturing, and in addition, the resistance is changed due to the temperature and humidity change of the ambient environment and durability deterioration.

Therefore, this problem is obviated by the ATVC. For this purpose, as shown in FIG. 1, in the case where the voltage is applied to the outer secondary transfer roller 57, the image forming apparatus 100 includes a current detecting circuit 59 as a current detecting means for detecting the current flowing through the outer secondary transfer roller 57. Further, in a period other than a period in which the toner image is transferred onto the recording material, i.e., in a non-sheet-passing period in which the recording material does not pass through the secondary transfer portion, a plurality of different voltages are applied to the outer secondary transfer roller 57 and then currents flowing through the outer secondary transfer roller 57 are detected by the current detecting circuit 59. Then, on the basis of these detected currents and the applied voltages, a relationship between the current and voltage (a resistance of the outer secondary transfer roller 57 at that point of time) is obtained. The thus-obtained relationship between the current and the voltage, an optimum transfer voltage at which a target current passed through the outer secondary transfer roller 57 during sheet passing is obtained, and the constant voltage control is effected at the optimum transfer voltage. By using this method, a necessary transfer current can be passed while effecting the constant voltage control, and therefore it is possible to effect optimum transfer irrespective of the recording material width and the resistance of the outer secondary transfer roller 57.

Figure 4:
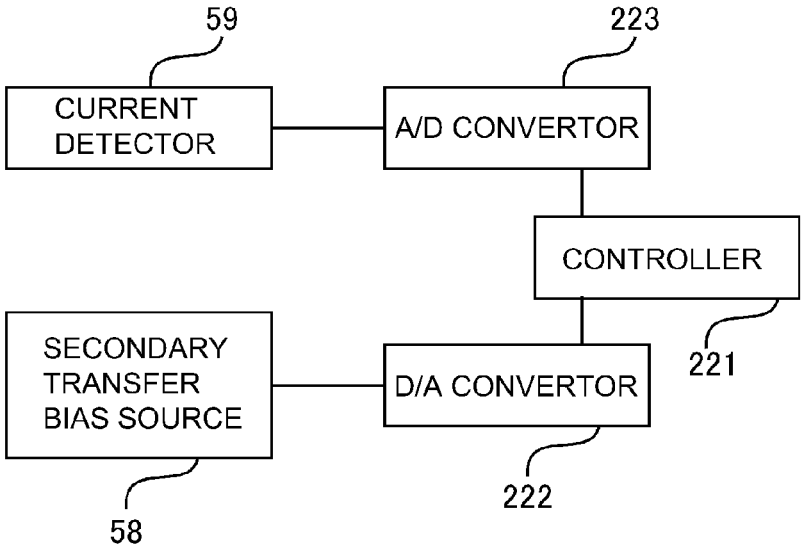
FIG. 4 is a block diagram showing a transfer voltage control device in First Embodiment.

A constitution in which the control of the voltage to be applied to the outer secondary transfer roller 57 is effected in the image forming apparatus 100 in this embodiment is shown in FIG. 4. Referring to FIG. 4, a controller 221 as a control means effect control of the entire image forming apparatus, such as control of the image forming operation, control of the voltage to be applied to each of the primary transfer portions and the secondary transfer portion, density control and the like. In the case where the voltage to be applied to the outer secondary transfer roller 57 is controlled by the controller 221, a PWM signal having a pulse width corresponding to a desired voltage is outputted from an OUT terminal.

This PWM signal is inputted into the secondary transfer bias power source 58 via a D/A converter 222, and then a voltage depending on the value of the PWM signal is applied to the outer secondary transfer roller 57. At this time, the current flowing through the outer secondary transfer roller 57 is detected by the current detecting circuit 59 and is converted into a digital signal by an A/D converter 223, and then is inputted into an IN terminal of the controller 221. The controller 221 sets on the basis of the applied voltages and the detected currents, the voltage to be applied to the outer secondary transfer roller 57 in the following manner.

[ATVC]

Then, a procedure of an example of the ATVC will be described.

(1) During non-sheet passing (in a non-sheet-passing period) before the recording material S is fed to the secondary transfer portion N2, a voltage V1 is applied to the outer secondary transfer roller 57 through one full turn of the outer secondary transfer roller 57. The current flowing through the outer secondary transfer roller 57 at this time is detected by the current detecting circuit 59 to obtain an average I1 of the current during one full turn of the outer secondary transfer roller 57.

(2) Then, during one full turn of the outer secondary transfer roller 57 during the non-sheet passing, a voltage V2 is applied. The current flowing through the outer secondary transfer roller 57 at this time is detected by the current detecting circuit 59 to obtain an average I2 of the current during one full turn of the outer secondary transfer roller 57.

Figure 5:
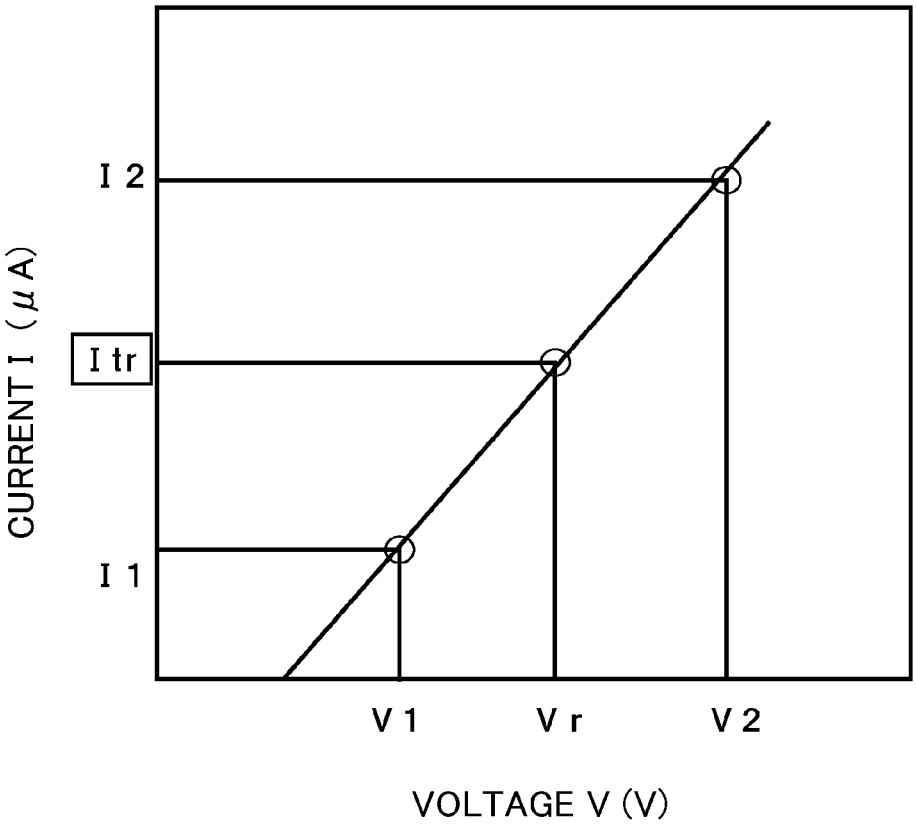
FIG. 5 is a graph for illustrating that a voltage necessary to pass an optimum current through a transfer member is obtained by linear interpolation.

(3) Further, as shown in FIG. 5, a current-voltage relationship is obtained by performing linear interpolation between a relationship between V1 and I1 and a relationship between V2 and I2, so that a necessary voltage Vr to pass an optimum transfer current (target current) Itr is obtained. Here, the target current Itr is, as described with reference to FIG. 3, obtained in advance as a current value showing a highest transfer efficiency by an experiment.

(4) Next, at timing when the toner image on the intermediary transfer belt 51 is transferred onto the recording material S, i.e., during sheet passing (in a sheet passing period) in which the recording material S passes through the secondary transfer portion N2, the constant voltage control is effected at a voltage Vtr=Vr+Vt obtained by adding a sharing voltage Vp of the recording material S to the above-obtained voltage Vr. As a result, an optimum transfer image is obtained. Incidentally, with respect to the sharing voltage Vp of the recording material S, an optimum value for each recording material is obtained in advance by an experiment and is stored in the controller 221.

The control as described above is, since the voltage is sequentially applied, referred to as PTVC (Programmable Transfer Voltage Control) in some cases but herein is referred to as the ATVC.

[Correction of Voltage to be Applied to Outer Secondary Transfer Roller]

Next, during a continuous image forming operation, correction of the voltage on the basis of the current detection at the secondary transfer portion N2 during the non-sheet passing will be described. First, a resistance fluctuation and improper transfer of the outer secondary transfer roller 57 during continuous sheet passing will be described. The present inventor confirmed a phenomenon that a secondary transfer property is gradually lowered in the case where continuous image formation is effected by using the image forming apparatus 100. When this phenomenon is studied, by temperature rise of the entire image forming apparatus due to the continuous image formation, also the outer secondary transfer roller 57 is increased in temperature, and as a result, the resistance value of the outer secondary transfer roller 57 is lowered, and therefore it was found that the secondary transfer current becomes excessive to result in an improper transfer image. In this image forming apparatus, as described above, the transfer voltage is set by effecting the ATVC before the transfer of the toner image onto the recording material S is started, and then the constant voltage control is effected.

Therefore, in the case where the resistance of the outer secondary transfer roller 57 is lowered in the continuous image formation, the secondary transfer current is deviated from the optimum value.

On the other hand, it would be considered that the ATVC is periodically carried out during the continuous image formation, but there is a need to interrupt the image forming operation to effect the control, and therefore there is a problem that productivity is lowered. On the other hand, as described above, separately from the ATVC effected during the non-sheet passing such as before the image formation, in the case where the transfer voltage is corrected by applying another voltage in the sheet interval as described in JP-A Hei 10-207262, there is a need to ensure a time required to detect the current by switching the voltage. For this reason, the image formation is not readily effected at high speed.

The present inventor considered an object of JP-A Hei 10-207272 in which the transfer voltage is lowered during the non-sheet passing. In the transfer of the toner image onto the recording material, when the same voltage is applied between during the non-sheet passing and during the sheet passing, the current flows in a large amount during the non-sheet passing. As described in JP-A Hei 10-207262, when the current is passed through the primary transfer portion, opposing the photosensitive drum, in the large amount during the non-sheet passing, a problem such as a memory image on the photosensitive drum is liable to occur.

However, in an experiment conducted by the present inventor, at the secondary transfer portion N2 where the intermediary transfer belt 51 opposes the inner secondary transfer roller 56, even in the case where the current flows in a somewhat large amount, a large problem did not occur. However, when a large current which is three times or more a normal transfer current was passed, it was found that the surface of the intermediary transfer belt 51 was deteriorated and the outer secondary transfer roller 57 and the inner transfer roller 56 were deteriorated by electric energy supply. That is, at the secondary transfer portion in the image forming apparatus using particularly the intermediary transfer member, when the value of the transfer current was suppressed to a predetermined current value or less, it was found that the image forming apparatus was capable of being used even when the current value in the sheet interval was high.

Therefore, in this embodiment, different from JP-A Hei 10-207262, the transfer voltage is applied to the outer secondary transfer roller 57 without being changed between during the sheet passing and during the non-sheet passing. Further, during the sheet passing and during the non-sheet passing, the constant voltage control is effected at a constant voltage to detect the current during the non-sheet passing, so that a resistance change of the outer secondary transfer roller 57 during the continuous image formation is detected, and then the voltage to be applied to the outer secondary transfer roller 57 is corrected.

Here, in order to prevent the current during the non-sheet passing from being excessively larger than the current during the sheet passing, the resistance at the entire secondary transfer portion may only be required to be set at a value higher than a predetermined value compared with the resistance of the recording material S, so that a difference in current depending on the presence or absence of the recording material S can be made small. The resistance value of a general-purpose recording material S is approximately $2\times10^7\Omega$, and therefore when the resistance of the entire secondary transfer portion is not less than $1\times10^7\Omega$which is ½ of the resistance value of the recording material S, the current during the non-sheet passing can be suppressed to a value which is not more than 3 times the current during the sheet passing.

In the image forming apparatus 100 in this embodiment, the resistance value of the entire secondary transfer portion is a combined resistance which is the sum of the resistances of the outer secondary transfer roller 57, the inner secondary transfer roller 56 and the intermediary transfer belt 51. With respect to the intermediary transfer belt 51, the resistance value is set in order to eliminate the need of a belt discharging member after the transfer is lower than the above-described resistance value of the entire secondary transfer portion by about one digit. Accordingly, the resistance of the entire secondary transfer portion is required to be ensured by the resistances of the outer secondary transfer roller 57 and the inner secondary transfer roller 56. For example, it is possible to set the resistance at $5\times10^6\Omega$ for the outer secondary transfer roller 57, $1\times10^6\Omega$ for the intermediary transfer belt 51, and $1\times10^4\Omega$ for the inner secondary transfer roller 56. However, when the resistance of the entire transfer portion is made excessively large, the applied voltage for obtaining the necessary transfer current becomes high, so that a defective image due to electric discharge at the secondary transfer portion is generated. Therefore, the resistance (combined resistance) of the entire secondary transfer portion may preferably be $1\times10^9\Omega$ or less. As a result, the combined resistance of the entire secondary transfer portion may preferably be $1\times10^7\Omega$ or more and $1\times10^9\Omega$ or less. Incidentally, the values of the respective resistances are those as measured under application of the voltage (of 2000 V) during the rotation.

[Voltage Correction Sequence During Continuous Image Formation]

Then, a correcting method of the secondary transfer voltage during the continuous image formation in the image forming apparatus 100 in this embodiment will be described.

In this embodiment, as described above, the voltage is applied to the outer secondary transfer roller 57 without being changed between during the sheet passing in which the recording material S passes through the secondary transfer portion N2 and during the non-sheet passing in which the recording material S does not pass through the secondary transfer portion N2. Then, the controller 221 controls the secondary transfer bias power source 58 in the following manner. That is, on the basis of the currents detected by the current detecting circuit 59 during the non-sheet passing, the voltage to be thereafter applied to the outer secondary transfer roller 57 is corrected so that the target current can pass through the outer secondary transfer roller 57 during the sheet passing.

In order to make such correction, the controller 221 compares, of currents detected by the current detecting circuit 59 in a plurality of non-sheet-passing period, an initial current, in the case where a preset initial voltage is applied, with a current detected after the detection of the initial current. Then, on the basis of a comparison result, the voltage to be thereafter applied to the outer secondary transfer roller 57 is corrected.

Here, setting of the initial voltage is made in the following manner. First, the controller 221 applies a plurality of different voltages to the outer secondary transfer roller 57 during the non-sheet passing, and then on the basis of currents detected by the current detecting circuit 59 and the plurality of different voltages described above, a relationship between the currents and the voltages is obtained (ATVC). Then, the above-described initial voltage is set so that the target current flows through the outer secondary transfer roller 57 during the sheet passing.

Figure 6:
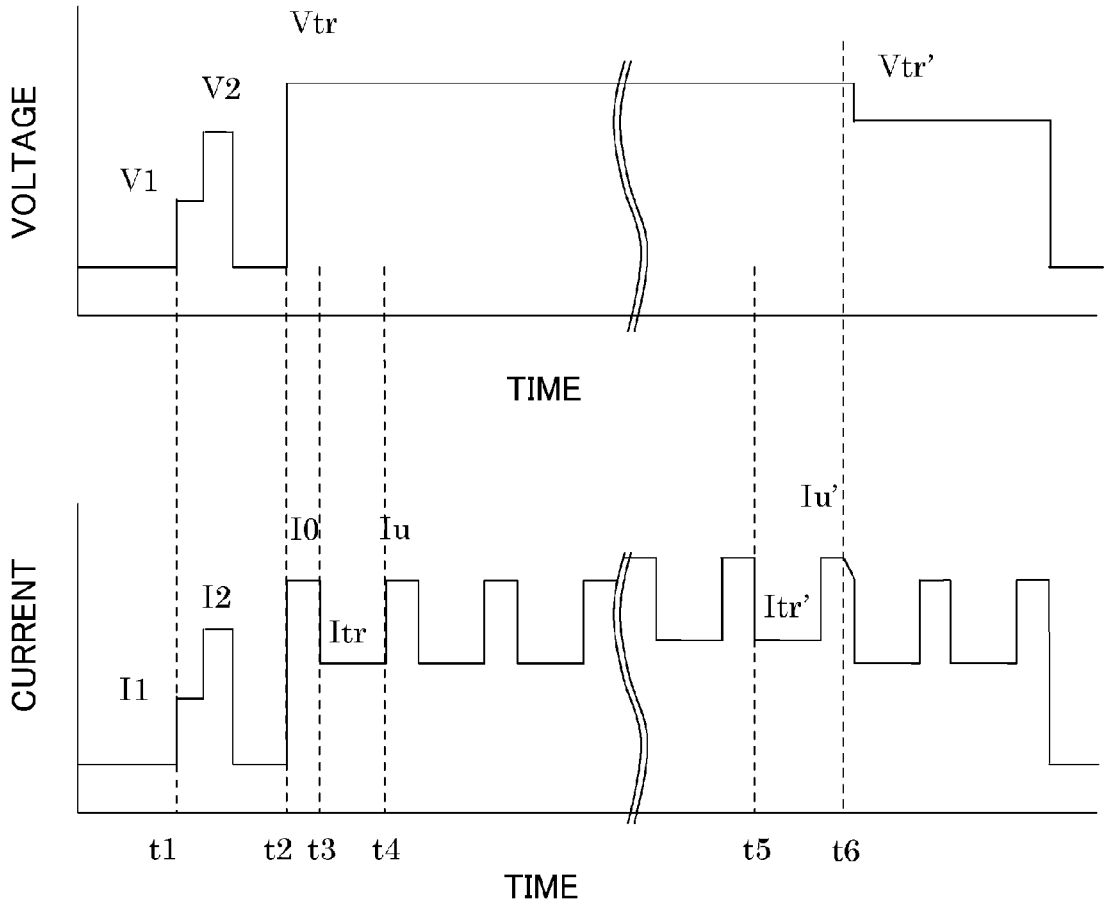
FIG. 6 includes time charts for illustrating a relationship between the transfer voltage and a transfer current in First Embodiment.

The description will be made specifically with reference to FIG. 6. FIG. 6 shows a relationship the voltage applied at the secondary transfer portion N2 and the current flowing at that time in the case where the continuous image formation is effected in this embodiment.

(1) First of all, during the non-sheet passing before the transfer of the toner image onto the recording material S, the ATVC for determining the initial voltage is effected. In this embodiment, at timing t1, voltages V1 and V2 at two levels are applied, and currents I1 and I2 at two levels are detected.

(2) The initial voltage Vtr (=Vr+Vp) set as a result of the above detection is, as a constant voltage, applied to the outer secondary transfer roller 57 from the secondary transfer bias power source 58. The timing when the initial voltage is started to be applied is during the non-sheet passing before the recording material S enters the secondary transfer portion N2, and is t2 before a time when one full turn of the outer secondary transfer roller 57 is ended. In a period from the application of the initial voltage Vtr to the end of the one full turn of the outer secondary transfer roller 57, the current flowing through the outer secondary transfer roller 57 is detected by the current detecting circuit 59, and an average of the current in the period is stored as an initial current I0 in the controller 221. The initial current I0 flowing at that time is the current during the non-sheet passing. The initial current I0 was higher than the transfer current Itr flowing during the sheet passing by about 30% in this embodiment. Incidentally, in the case where a degree of resistance non-uniformity during the one full turn of the outer secondary transfer roller 57 is not large, the one full turn of the outer secondary transfer roller 57 is not necessarily required. That is, the current detection may also be performed in a shorter time (period) than a period corresponding to the one full turn.

(3) Then, the transfer current flowing at timing t3 during the sheet passing in which the recording material S passes through the secondary transfer portion N2 is Itr. On the other hand, a current Iu in sheet interval at timing t4 during the non-sheet passing is higher than the transfer current Itr. This current Iu in predetermined sheet intervals is detected by the current detecting circuit 59 in real time. The current detection in the sheet intervals may be performed in all the sheet intervals during continuous sheet passing and may also be performed once or plural times for each of sheet passing of a plurality of sheets. In either case, in this embodiment, the voltage is not switched in the sheet intervals, and therefore there is no need to wait for a switching time of a high voltage when the currents in the sheet intervals are detected, so that the sequence in this embodiment can meet the current detection in a short sheet interval.

(4) Thereafter, at timing t5 when the temperature of the outer secondary transfer roller 57 is increased by the continuous image formation and thus the resistance is lowered, a transfer current Itr' during the sheet passing is increased, so that the transfer current Itr' is deviated from the optimum transfer current. Therefore, the controller 221 compares a deviation amount of a current Iu' from the initial current I0 in each of the sheet intervals in which the current is detected. Then, in the case where the deviation amount is a predetermined value or more, the voltage to be applied to the outer secondary transfer roller 57 is corrected at timing t6 during the non-sheet passing, so that the image forming apparatus prepares for subsequent transfer of the toner image onto the recording material S. In this embodiment, in the case where 5% or more is deviated between the current Iu (Iu') in the sheet interval and the initial current I0, the voltage to be applied to the outer secondary transfer roller 57 is increased or decreased by a value determined in advance by an experiment or the like.

Thereafter, in a similar manner, each of currents Iu, Iu', Iu", . . . in the sheet intervals is compared with the initial current I0, and in the case where the deviation amount is a predetermined value or more, the voltage to be applied to the outer secondary transfer roller 57 is corrected. That is, by correcting the voltage, the current is made equal to (or close to) the initial current I0, but by the resistance change or the like of the outer secondary transfer roller 57 caused thereafter, the current detected in the sheet interval is deviated again in such an order of Iu, Iu', Iu", . . . . Accordingly, each current is compared with the initial current I0 similarly as in the above-described case, so that the voltage to be applied to the outer secondary transfer roller 57 is corrected.

By the above-described procedure, the transfer voltage is corrected in real time while detecting the current at the non-sheet passing portion, whereby it is possible to obviate improper transfer during the continuous image formation.

Incidentally, the reason why the correction after detection of the current during the sheet passing is not made is that the transfer current fluctuates depending on the presence or absence of the toner image to be transferred, and therefore the resistance fluctuation of the transfer roller cannot be accurately detected.

Further, in this embodiment, a correction amount when the voltage is corrected is a predetermined fixed value, but the voltage to be corrected may also be determined from the relationship, between the current and the voltage, obtained by the ATVC. Further, the detection timing of the initial current I0 is not limited to before the image formation but may also be an earlier sheet interval such as a sheet interval between first and second sheets.

In the case of this embodiment, as described above, on the basis of the current detected by the current detecting circuit 59 under application of the voltage during the non-sheet passing, the voltage to be thereafter applied to the outer secondary transfer roller 57 so that the target current flows through the outer secondary transfer roller 57 during the sheet passing. For this reason, irrespective of the resistance fluctuation of the outer secondary transfer roller 57, the improper transfer can be suppressed. Further, the voltage is applied to the outer secondary transfer roller 57 without being changed between during the sheet passing and during the non-sheet passing, and therefore the current detection time during the non-sheet passing can be shortened. For this reason, the sheet interval as the non-sheet-passing period can be shortened, so that the image can be formed at high speed.

<Second Embodiment>

Figure 7:
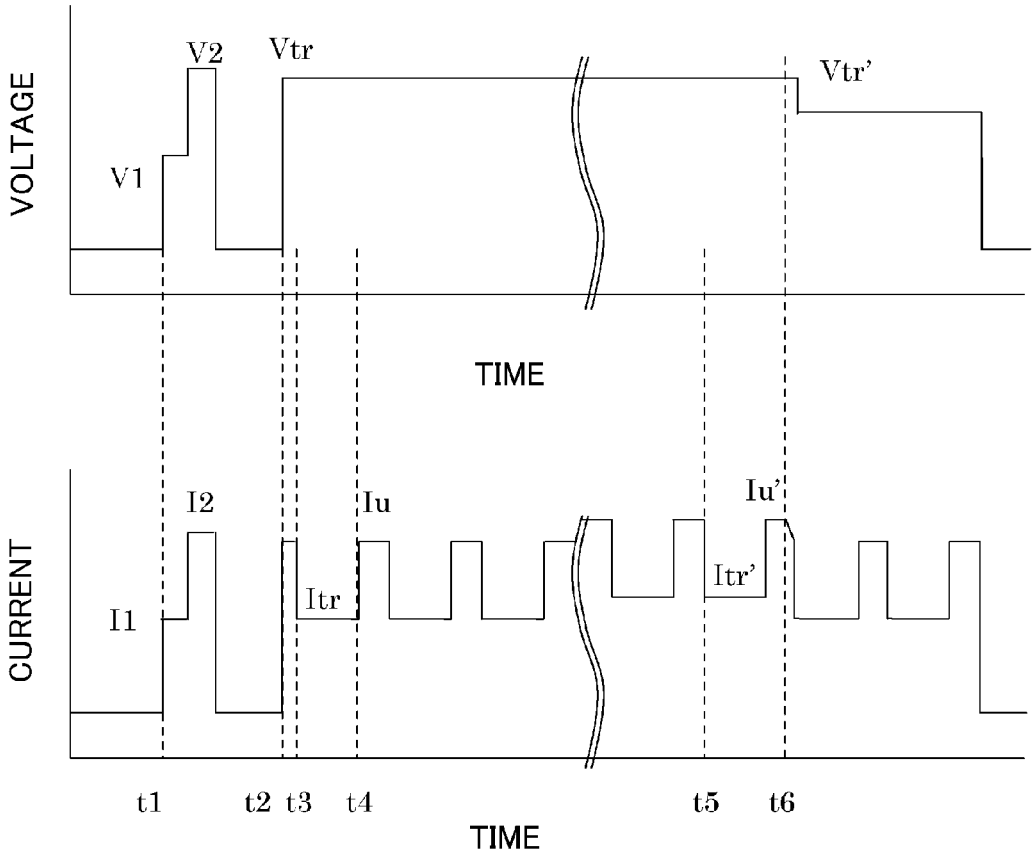
FIG. 7 includes time charts for illustrating a relationship between a transfer voltage and a transfer current in Second Embodiment.

Second Embodiment of the present invention will be described with reference to FIGS. 7 to 9 in combination with FIG. 1.

Incidentally, a basic constitution and operation of the image forming apparatus in this embodiment are the same as those in First Embodiment, and therefore detailed description is omitted and a detect portion from First Embodiment will be principally described. In this embodiment, in place of the detection of the initial current I0 as in First Embodiment, a reference current (first current) during the non-sheet passing is obtained in advance from a relationship (first relationship), between the currents and the voltages, obtained by the ATVC.

That is, the controller 221 applies a plurality of different voltages to the outer secondary transfer roller 57 during the non-sheet passing, and then on the basis of currents detected by the current detecting circuit 59 and the plurality of different voltages, the first relationship between the currents and the voltages is obtained (ATVC). Then, from the first relationship, a first current flowing through the outer secondary transfer roller 57 in the case where a first voltage corresponding to the target current flowing through the outer secondary transfer roller 57 during the sheet passing is applied during the non-sheet passing. The first current may be detected by the current detecting circuit 59 by actually applying the first voltage, but in this embodiment, is calculated from the first relationship.

Then, from a relationship between the first current and a second current detected by the current detecting circuit 59 in the case where the first voltage is applied in a non-sheet-passing period after the first relationship is obtained, a second voltage corresponding to the target current flowing through the outer secondary transfer roller 57 during the sheet passing is obtained. In this embodiment, from the relationship between the first current and the second current, by using the first relationship, a second relationship between the current and the voltage at that time is obtained, and from the second relationship, a second voltage corresponding to the target current flowing through the outer secondary transfer roller 57 is obtained. The controller 221 controls the secondary transfer bias power source 58 so that the voltage to be thereafter applied to the outer secondary transfer roller 57 is corrected to the second voltage.

A specific sequence will be specifically described below with reference to FIGS. 7 to 9. FIG. 7 shows a relationship between the voltage applied to the outer secondary transfer roller 57 and the current flowing at that time in the case where the continuous image formation is effected in this embodiment.

(1) First of all, at timing t1 during the non-sheet passing before the transfer of the toner image onto the recording material S, the ATVC for determining the transfer voltage is effected. In this case, voltages V1 and V2 at two levels are applied, and currents I1 and I2 at two levels are detected. At this time, the voltages V1 and V2 in this embodiment are made higher than those in First Embodiment so that a voltage-current characteristic in a current region of an initial current (first current) during the non-sheet passing can be obtained.

Figure 8:
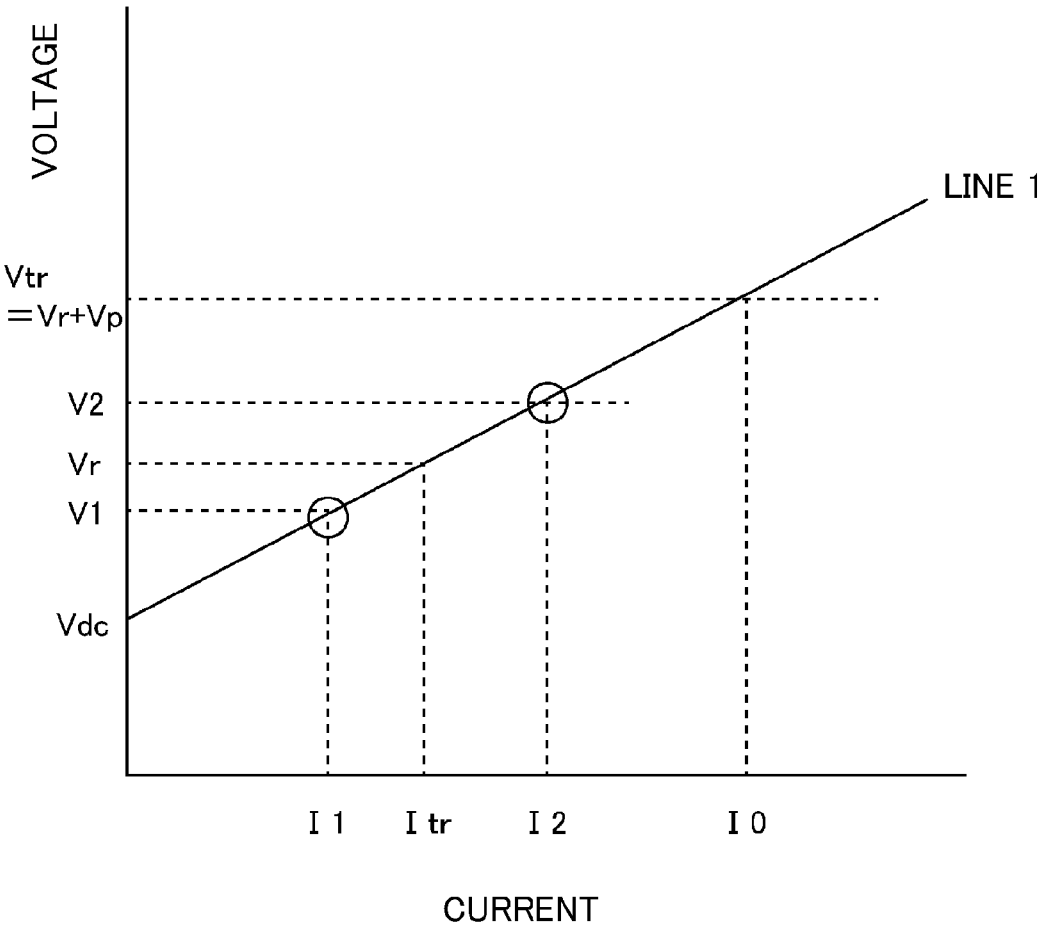
FIG. 8 is a graph showing a relationship between the transfer voltage and the transfer current during an initial stage in Second Embodiment.

(2) The above-obtained relationship between the voltage and the current (first relationship) is shown in FIG. 8. From the relationship of FIG. 8, a voltage Vr necessary to pass a current Itr during the non-sheet passing is calculated. Then, the initial current I0, during the non-sheet passing, flowing through the outer secondary transfer roller 57 under application of an initial voltage Vtr (=Vr+Vp) obtained by adding a sharing voltage Vp of the recording material S to the voltage Vr is calculated. In this embodiment, by calculating the initial current I0 from the result (first relationship) of the ATVC, it becomes possible to shorten a time required for detecting the current before the sheet passing.

(3) Next, at timing t2 during the non-sheet passing before the recording material S enters the secondary transfer portion N2, the set initial voltage Vtr (=Vr+Vp) is, as a constant voltage, applied to the outer secondary transfer roller 57 from the secondary transfer bias power source 58.

(4) Thereafter, during continuous image formation, currents Iu (second current) in predetermined sheet intervals are detected by the current detecting circuit 59 in real time. At timing t5 when the temperature of the outer secondary transfer roller 57 is increased by the continuous image formation and thus the resistance is lowered, a transfer current Itr' during the sheet passing is increased, so that the transfer current Itr' is deviated from the optimum transfer current. Therefore, the controller 221 compares a deviation amount of a current (second current) Iu' from the initial current I0 in each of the sheet intervals in which the current is detected. Then, in the case where the deviation amount is a predetermined value or more, the voltage to be applied to the outer secondary transfer roller 57 is corrected at the following method.

Figure 9:
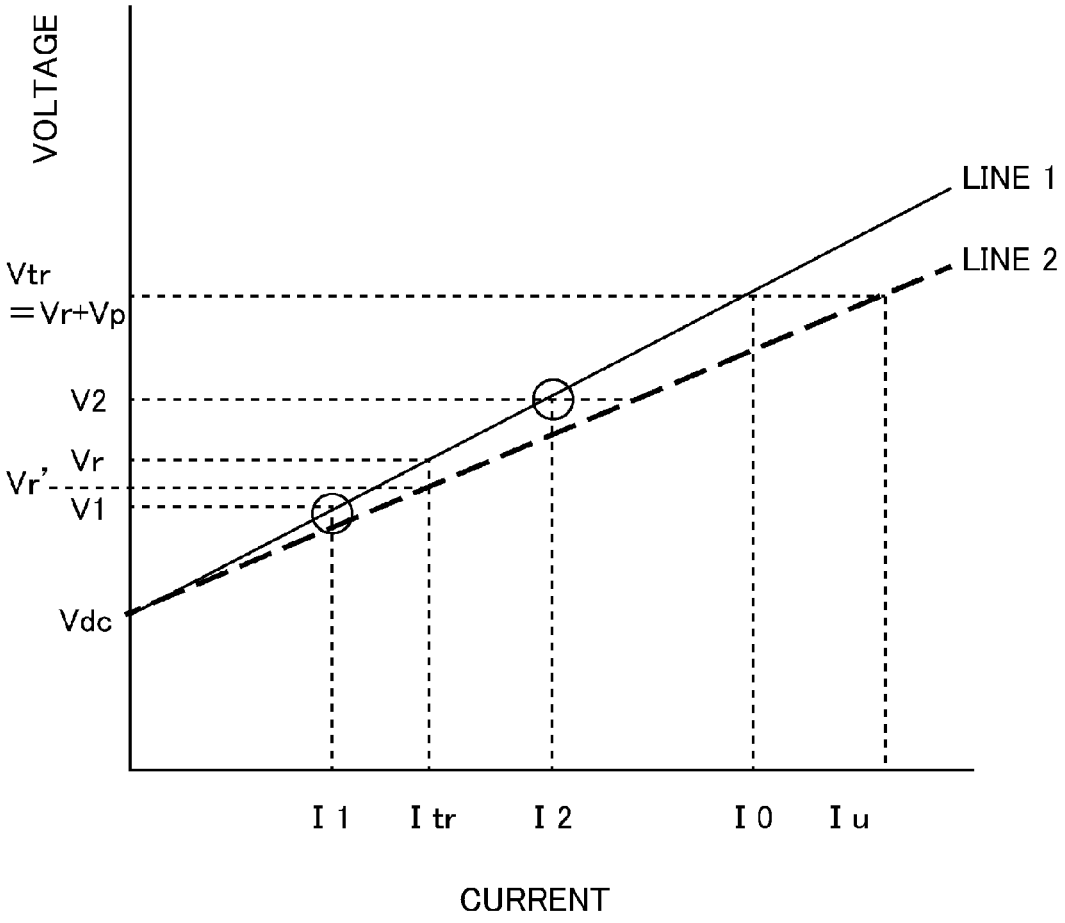
FIG. 9 is a graph showing a relationship between the transfer voltage and the transfer current during each of the initial stage and continuous image formation in Second Embodiment.

Here, a relationship between the voltage and the current in the case where the temperature of the outer secondary transfer roller 57 is increased by the continuous image formation and thus the resistance is lowered is shown in FIG. 9. In FIG. 9, line 1 is a rectilinear line which is the same as line 1 shown in FIG. 8, and shows the relationship (first relationship), between the voltage and the current, obtained during the ATVC. Further, line 2 shows a relationship (second relationship) between the voltage and the current in the case where the resistance of the outer secondary transfer roller 57 is lowered. These rectilinear lines are represented by the following formulas.

Line 1: $V=K\times I+Idc$

Line 2: $V=K'\times I+Vdc$

In the above formulas, each of K and K' represents a slope of the associated rectilinear line, and Vdc represents an electric discharge start voltage.

From FIG. 9, with respect to line 1, Vtr=K×I0+Vdc is satisfied, and with respect to line 2, Ltr=K'×Iu+Vdc is satisfied, and therefore a relationship of: K'=K×(I0×Iu) can be obtained. Accordingly, a voltage (second voltage) Vtr' to be set when the resistance of the outer secondary transfer roller 57 is lowered is represented by a formula below when in the relationship of line 2, a voltage at which the target current Itr flows through the outer secondary transfer roller 57 during the non-sheet passing is Vr'.

$$\begin{aligned} Vtr' &= Vr' + Vp \\ &= (K' \times Itr + Vdc) + Vp \\ &= (K \times (I0 / Iu)) \times Itr + Vdc) + Vp \end{aligned}$$

The voltage to be applied to the outer secondary transfer roller 57 at timing t6 during the non-sheet passing is corrected to the second voltage Vtr' obtained from the above formula, and then the image forming apparatus prepares for subsequent transfer of the toner image onto the recording material S. Thereafter, in a similar manner, the initial current I0 is compared with each of currents Iu, Iu', Iu'', . . . in the sheet intervals to obtain a relationship such as line 2, thus obtaining the second voltage similar as in the above-described case. Then, the voltage to be applied to the outer secondary transfer roller 57 is corrected to the second voltage.

By the above-described procedure, the transfer voltage obtained in the ATVC is corrected in real time after detecting the current at the non-sheet passing portion, whereby it is possible to obviate improper transfer during the continuous image formation.

Incidentally, in this embodiment, the voltage to be corrected is calculated by using the relationship (first relationship) obtained from the result of the ATVC but is not limited thereto. For example, it is also possible to use a predetermined fixed correction value corresponding to the relationship between the second current and the first current. Other constitutions and actions are similar to those in First Embodiment.

In the above-described embodiments, the image forming apparatus using the intermediary transfer belt 51 has been described, but the present invention is also applicable to an image forming apparatus in which the toner image is directly transferred from the photosensitive drum onto the recording material, in which case the photosensitive drum is the image bearing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 128993/2012 filed Jun. 6, 2012, which is hereby incorporated by reference.

What is claimed is:

1. An image forming apparatus comprising:

an image bearing member;

a toner image forming portion configured to form a toner image on said image bearing member;

a transfer member configured to transfer the toner image from said image bearing member onto a recording material at a transfer position;

a power source configured to apply a voltage to said transfer member;

a detecting member configured to detect a current flowing through said transfer member during a non-sheet-passing period in which the recording material is not in the transfer position, a setting portion configured to set a first voltage, where a target current flows through said transfer member when the first voltage is applied to said transfer member in a sheet-passing period in which the recording material is in the transfer position, based on detection results of said detecting member under application of a plurality of different test voltages in a test mode in advance, where a first current flows through said transfer member when the first voltage is applied to said transfer member in the non-sheet-passing period, during a first period; and an executing portion configured to execute an adjusting mode, in which in a case that images are continuously formed on a plurality of recording materials, the first voltage is applied to said transfer member during both a plurality of non-sheet-passing periods and a plurality of sheet-passing periods, during the first period, then the first voltage is adjusted so that the detection result under application of a voltage is the first current, during a second period later than the first period.

2. An apparatus according to claim 1, wherein in the adjusting mode, the first voltage is adjusted when an absolute value of a difference between the detection result of the detecting member and the first current is a predetermined value or more.

3. An apparatus according to claim 1, wherein said setting portion sets the first voltage on the basis of the detection results under application of a plurality of different voltages during the first period.

4. An apparatus according to claim 3, wherein said setting portion sets a first relationship on the basis of the detection results under application of the plurality of different voltages during the first period, a second current on the basis of the detection result under application of the first voltage during the second period, a second relationship on the basis of the first voltage and the second current, and a second voltage on the basis of the first current, the second current, the first relationship, and the second relationship, and the first voltage is adjusted to the second voltage in the adjusting mode.

5. An apparatus according to claim 1, wherein said transfer member is a transfer roller including a resistance layer having an ion conductivity.

6. An apparatus according to claim 1, wherein a combined resistance at the transfer position is $1\times10^{7}\Omega$ or more and $1\times10^{9}\Omega$ or less.

7. An apparatus according to claim 1, wherein said image bearing member is an intermediary transfer belt.

8. An apparatus according to claim 1, wherein said image bearing member is a photosensitive drum.

* * * * *